US005871434A

United States Patent [19]

Eckelt et al.

[11] Patent Number: 5,871,434

[45] Date of Patent: Feb. 16, 1999

[54] DEVICE FOR STIFFENING FLAT WORKPIECES OF PAPER OR THE LIKE

[75] Inventors: Ulrich Eckelt, Tecklenburg; Horst Rautenberg, Lienen, both of Germany

[73] Assignee: Windmöller & Hölscher, Lengerich/Westf., Germany

[21] Appl. No.: 766,665

[22] Filed: Dec. 4, 1996

[30] Foreign Application Priority Data

Dec. 5, 1995 [DE] Germany ..... 195 45 349.2

[51] Int. Cl.[6] ..... B31F 1/00

[52] U.S. Cl. ..... 493/461; 493/459; 271/188; 271/209

[58] Field of Search ..... 493/395, 459, 493/460, 461, 465; 271/188, 209

[56] References Cited

U.S. PATENT DOCUMENTS

| | | | |
|---|---|---|---|
| 3,073,217 | 1/1963 | Spalding et al. . | |
| 3,988,019 | 10/1976 | Achelpohl | 271/180 |
| 4,540,396 | 9/1985 | Berthelsen . | |
| 5,091,754 | 2/1992 | Abe | 271/188 |
| 5,104,117 | 4/1992 | McCormick | 493/459 |
| 5,112,291 | 5/1992 | VerMehren . | |
| 5,165,679 | 11/1992 | Kinomoto | 271/188 |
| 5,299,371 | 4/1994 | Haberstroh | 38/9 |
| 5,501,446 | 3/1996 | Takemoto | 271/188 |
| 5,555,083 | 9/1996 | Kuo | 271/188 |

FOREIGN PATENT DOCUMENTS

| | | | |
|---|---|---|---|
| 1 511 033 | 9/1969 | Germany . | |
| 0089766 | 3/1990 | Japan | 271/188 |

*Primary Examiner*—Jack W. Lavinder
*Attorney, Agent, or Firm*—Evenson, McKeown, Edwards & Lenahan, PLLC

[57] ABSTRACT

A device for stiffening workpieces of paper includes elements that provide the workpieces with an undulated profile. The elements may be in the form of freely rotatable disks or belts that revolve around freely rotatable rollers. Respective sections of the disks or belts which come in contact with the workpieces extend through a common central plane in such a way that they provide the workpieces with an undulated profile. In order to prevent the profiling elements from laterally displacing the workpieces, a conveyor is provided which clamps the workpieces between respective conveyor sections.

4 Claims, 4 Drawing Sheets

DEVICE FOR STIFFENING FLAT WORKPIECES OF PAPER OR THE LIKE

BACKGROUND OF THE INVENTION

1. Field of the Invention

This invention pertains to a device for stiffening workpieces of paper or the like and, in particular, to a device for stiffening tubular sections used in the manufacture of bags.

2. Description of Related Art

When collecting or additionally processing sections that have been severed from a paper web, the sections need to be stacked or transported. The flexibility or limberness of the paper sections can cause problems in properly positioned depositing or additional transporting of these paper sections.

In the manufacture of paper bags, paper webs are initially unwound from reels. The paper webs are placed on top of one another in a multilayered fashion. Subsequently, tubular webs are formed by folding in overlapping side parts and gluing together the overlapping regions. Tubular sections that are either stacked or deposited on a slat belt conveyor in imbricated fashion at high speeds are subsequently severed from these tubular webs. In order to prevent the tubular sections that were severed from the tubular web from assuming an oblique position and not exactly aligning with one another due to their limberness and/or flexibility while they are deposited on the slat belt conveyor, it is known to convey the tubular sections through cooperating disks that provide the tubular sections with an undulated profile. This undulated profile stiffens the tubular sections such that they are no longer able to bend or overturn about their lateral axes. However, the profiling disks that are usually arranged on both sides of the central longitudinal axis of the workpieces tend to laterally entrain the material of the tubular sections in an uncontrollable fashion. In this case, it is uncertain on which side the material is entrained. The lateral edges of the workpieces, therefore, may not be exactly aligned when the workpieces are deposited on the subsequently arranged slat belt conveyor in imbricated fashion.

SUMMARY OF THE INVENTION

This invention is based on the objective of developing a device which ensures that workpieces with an undulated profile produced by respective profiling elements are deposited such that their edges are linearly aligned.

According to the invention, this objective is attained with a device for stiffening flat workpieces of paper or the like, such as tubular sections used in the manufacture of bags. This device includes elements that provide the workpieces with an undulated profile. These elements may be, for example, freely rotatable disks or belts that revolve around freely rotatable rollers. The respective sections of the disks or belts that come in contact with the workpiece extend through their common central plane in such a way that they provide the workpieces with an approximately undulated profile. A conveyor is arranged within the region of the profiling elements and clamps the workpieces between its respective sections. According to the invention, the conveyor is provided with a separate drive and fixes the workpieces, during their passage through the profiling elements, in such a way that a lateral displacement of the workpieces is precluded. The workpieces are provided with a stiffening profile without causing a lateral displacement. The undulated workpieces, in other words, can be stacked or deposited on a subsequently arranged slat belt conveyor so that problems during additional processing, due to an inadequate alignment of the workpieces relative to one another, are eliminated.

It is practical to have the conveyor that fixes the workpieces be a two-belt conveyor. In order to exert a sufficient clamping force upon the workpieces, the sections of the two-belt conveyor may extend over intermediate support rollers that are arranged in pairs. One of the intermediate support rollers, in this case, is pressed against the opposite intermediate support roller by a spring force.

It is also practical for the two-belt conveyor to take hold of the workpieces within the region of their central axes. In order to provide the workpieces with a symmetric undulated profile, the profiling elements are preferably arranged as mirror images on both sides of the central longitudinal axis of the workpieces.

In order to simply and rapidly change the undulated profile produced in accordance with the type of workpiece and the respective requirements, the belts that revolve around freely rotatable rollers are preferably arranged in frames that can be adjusted relative to one another within the machine frame. The intake ends of the frames may be arranged in the machine frame in pivoted fashion. Opposite ends of the frames are provided with adjusting devices for raising and lowering the profiling elements so as to be able to change the depth of the undulated profiles in accordance with the respective requirements.

The adjusting devices can be cams.

It is practical for two respective rollers to be arranged equiaxially in one frame. Two endless belts revolve parallel to one another around the aforementioned rollers. In this case, rollers are also arranged in the other frame that accommodates only one endless belt. The latter belt is arranged in the central plane between the two belts that revolve parallel to one another.

The deflection rollers on the outlet side, which are also arranged in pairs, may have larger diameters than the deflection rollers on the intake side. It is possible, in this way, to increase the depth of the undulated profiles beginning at the intake end of the frame.

In one additional configuration of the invention, curved profiling plates are arranged on one of the frames. In this case, the lateral regions of the workpieces pass between these curved profiling plates. Consequently, the profiling plates provide the lateral regions of the workpieces with an additional stiffening profile.

The height of the profiling elements relative to the clamping sections of the two-belt conveyor may also be realized in adjustable fashion such that an approximately roof-shaped profile can be produced within the central region of the workpieces.

BRIEF DESCRIPTION OF THE DRAWINGS one example of the invention is described in detail below with reference to the figures.

DESCRIPTION OF THE PREFERRED EMBODIMENT

Figure 1:
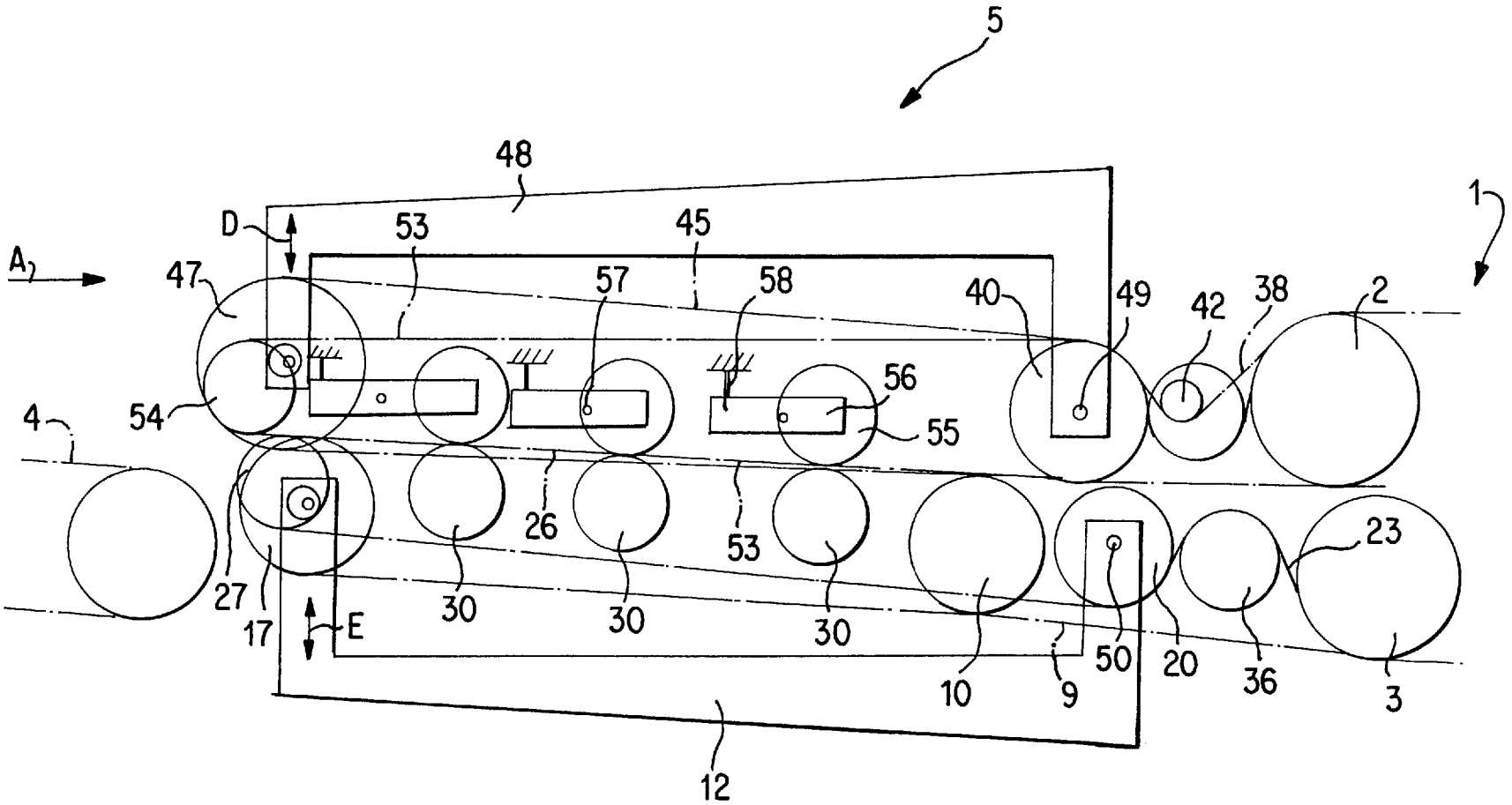
FIG. 1 is a schematic side view of the device according to the invention for profiling flat workpieces or tubular sections.

A two-belt conveyor 1 includes assemblies of endless belts that form upper and lower sections of the two-belt conveyor and revolve around the front deflection rollers 2,3. This two-belt conveyor individually transports tubular sections to be deposited on the slat belt conveyor 4 in imbricated fashion and transfers the tubular sections to the profiling elements 5. The front deflection rollers 2,3 of the two-belt conveyor 1, which is provided with a separate drive, are arranged in the side parts 6,7 of a machine frame that is not illustrated in detail. Two belts 8,9 of the belt assembly that revolves around the lower deflection roller 3 of the two-belt conveyor 1 revolve around the rollers 10,10'. The rollers 10,10' are arranged in a freely rotatable fashion in lower frames 11,12. At their intake ends, the lower frames are arranged such that they can be pivoted about pins mounted to the side parts 6,7. The rollers 10,10' are driven by the belts 8,9.

On their inner sides that face one another, the rollers 10,10' are provided with annular grooves that accommodate the endless, round belts 14,15. These endless, round belts are deflected by the front deflection rollers 16,17 that are arranged in a freely rotatable fashion on the front end region of the frame 12.

A roller 20 that laterally carries two equiaxial pulleys 21,21' is arranged in a freely rotatable fashion in the machine frame and centrally within the intake region of the frame 12. Bands or belts 22,23 of the belt assembly revolving around the lower deflection roller 3 of the two-belt conveyor 1 extend between these pulleys and the drive of the roller 20. The roller 20 is provided with a central pulley 25 for accommodating an endless belt 26 that is deflected by the front deflection roller 27. This front deflection roller is arranged in a freely rotatable fashion in the machine frame. The upper section of the belt 26 forms one section of the two-belt conveyor 29 that clamps the workpieces between its respective sections and transports the workpieces through the profiling element 5. The upper section of the endless belt 26 is supported between the pulleys or rollers 25,27 by intermediate support rollers 30 arranged in a freely rotatable fashion on angled carriers 31 of the machine frame.

The bands or belts 22,23 that drive the roller 20 with the three pulleys are partially looped around tensioning rollers 35,36 that are arranged in the machine frame in a customary fashion. Two belts 37,38 of the belt assembly that revolves around the upper deflection roller 2 of the two-belt conveyor 1 drive the freely rotatable rollers 39,40 arranged in the machine frame. The belts 37,38 are provided with conventional tensioning rollers 41,42 arranged in the machine frame. The rollers 39,40 are provided with lateral annular grooves that respectively accommodate pairs of belts 44 and 45. The belts 44,45 are guided around the front deflection rollers 46,47 which have larger diameters than the rollers 39,40. The deflection rollers 46,47 are arranged in a freely rotatable fashion in an upper frame 48.

The upper and lower frames 12,48 are arranged in the side parts 6,7 of the machine frame such that they can be pivoted about axes 49,50. These axes are arranged flush with the axes of the rollers 20 and 40. One additional roller 52 on the intake side of the upper section of the two-belt conveyor 29 is arranged in a freely rotatable fashion in the machine frame. The upper section 53 of the two-belt conveyor 29 extends over the support rollers 55 and the front deflection roller 54 arranged in a freely rotatable fashion in the machine frame. The support rollers 55 are arranged in a freely rotatable fashion on two-armed levers 56 arranged in the machine frame such that they can be pivoted about axes 57 and prestressed on their other ends by tension springs 58. In this way, each support roller 55 adjoins the opposite support roller 30 with a certain prestress as is evident from FIG. 2. The upper section 53 of the two-belt conveyor 29 is formed by one belt of the belt assembly of the two-belt conveyor 1 which revolves around the upper deflection roller 2.

The front ends of the frames 12,48 are arranged in the machine frame such that their height can be adjusted by cam shafts 60,61 and 62,63. Cranks or actuators may be provided for turning the cam shafts. The depth at which the belts 14,15 engage between the belts 44 and 45 can be adjusted by changing or pivoting the frames 12,48 relative to one another. Consequently, the desired depth of the undulated profile produced by these belts can be adjusted. This adjusting option is indicated by the double arrows B and C in FIG. 2 and the double arrows D and E in FIG. 1.

Plates 67,68 with approximately identical curvatures are fastened to the arms 65,66 of the lower frames 12,12' in the form of a mirror image. The lateral regions of the sections to be profiled pass between these curved plates during their passage through the profiling elements. During this process, both lateral regions pass between the plates 67,68 and are provided with a corresponding arc-shaped profile.

In order to allow mutual pivoting of the frame parts 12,12' and 48,48', respectively, the upper frames are provided with fork-shaped slots 70. Projecting parts 71 of the lower frames 12,12' engage into these slots.

The frames 12,12' and 48,48' are guided on pins 62,63 and 60,61 that are rigidly fastened to the frame and provided with cams such that they can also be displaced relative to one another in the transverse direction. In order to carry out such an adjustment in the transverse direction, a spindle 74 with a thread is rotatably arranged in the side parts 6,7. Spindle nuts 75,76 with opposite threads are screwed onto this spindle. These spindle nuts 75,76 are guided in the frame such that they can be laterally displaced, but not turned. In addition, these spindle nuts are provided with a forked driver 77,78, into which the projecting parts 79,80 of the frame parts 12,12' engage. Consequently, the lateral distance between the frame parts with the belts that produce the profiling can also be adjusted by correspondingly turning the spindle 74.

Figure 2:
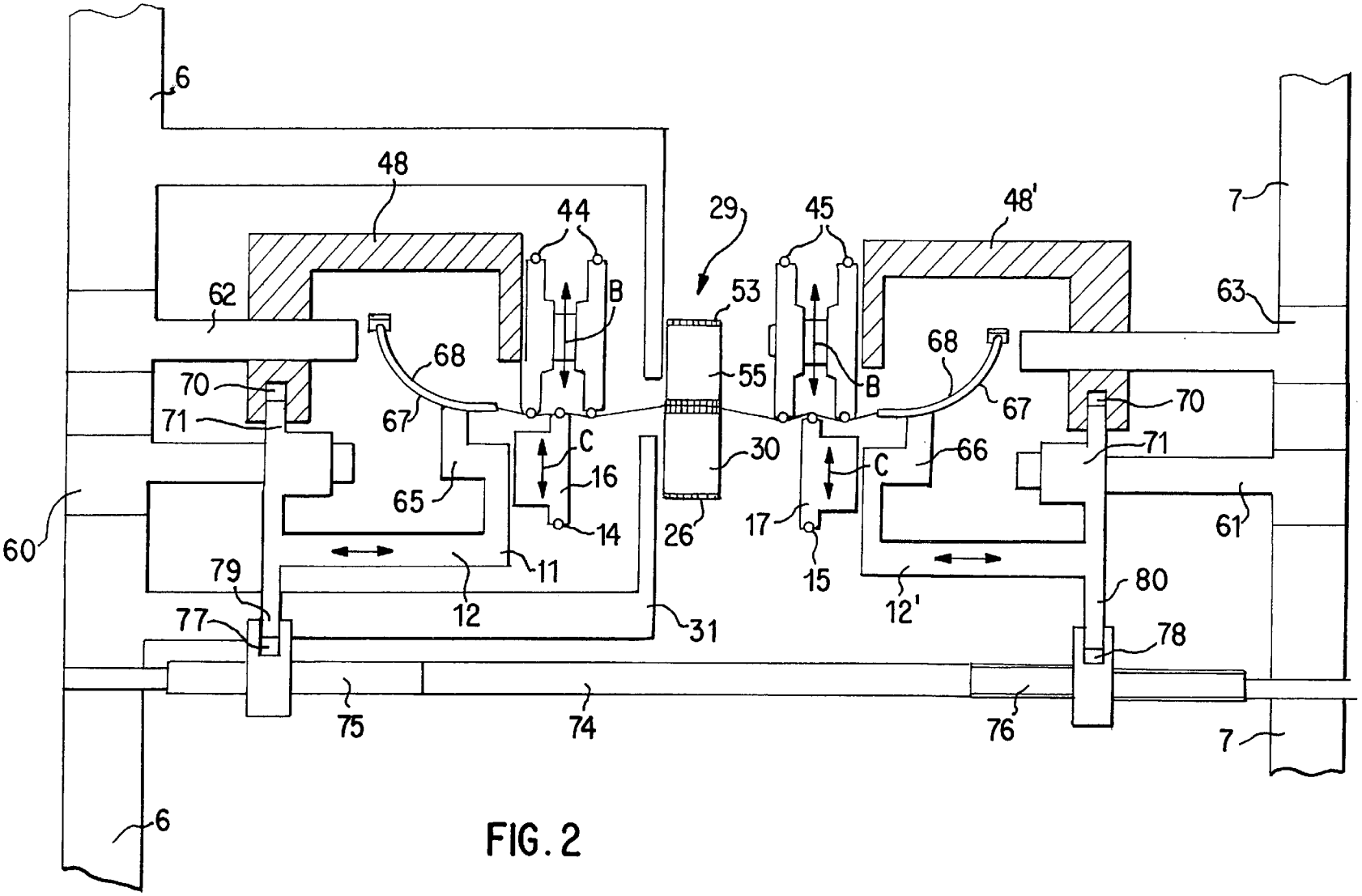
FIG. 2 is a partially sectioned view of the device in the direction of the arrow A in FIG. 1.
Figure 3:
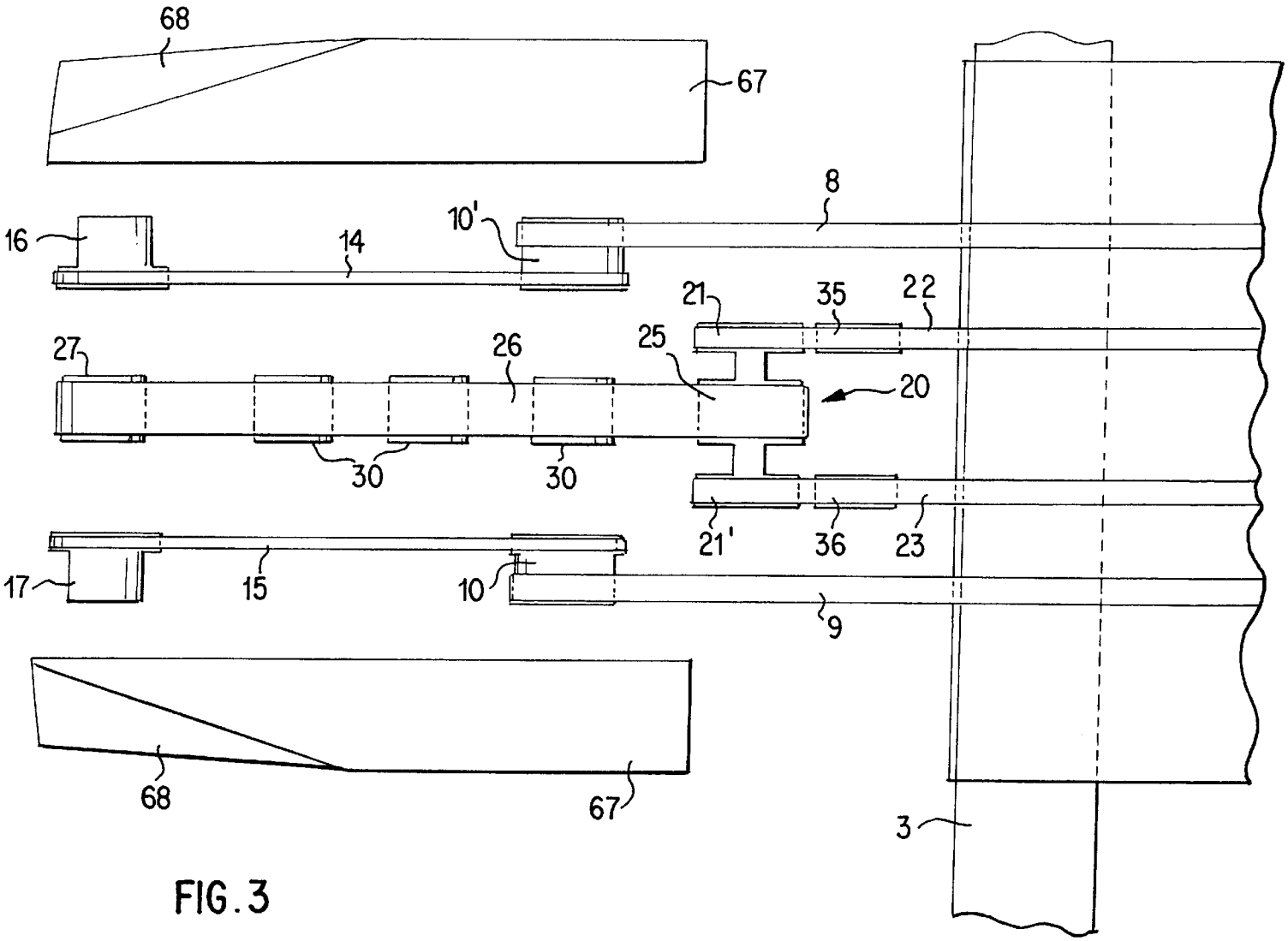
FIG. 3 is a top view of the lower bands and belts with the corresponding deflection and guide rollers after removing the upper frame.
Figure 4:
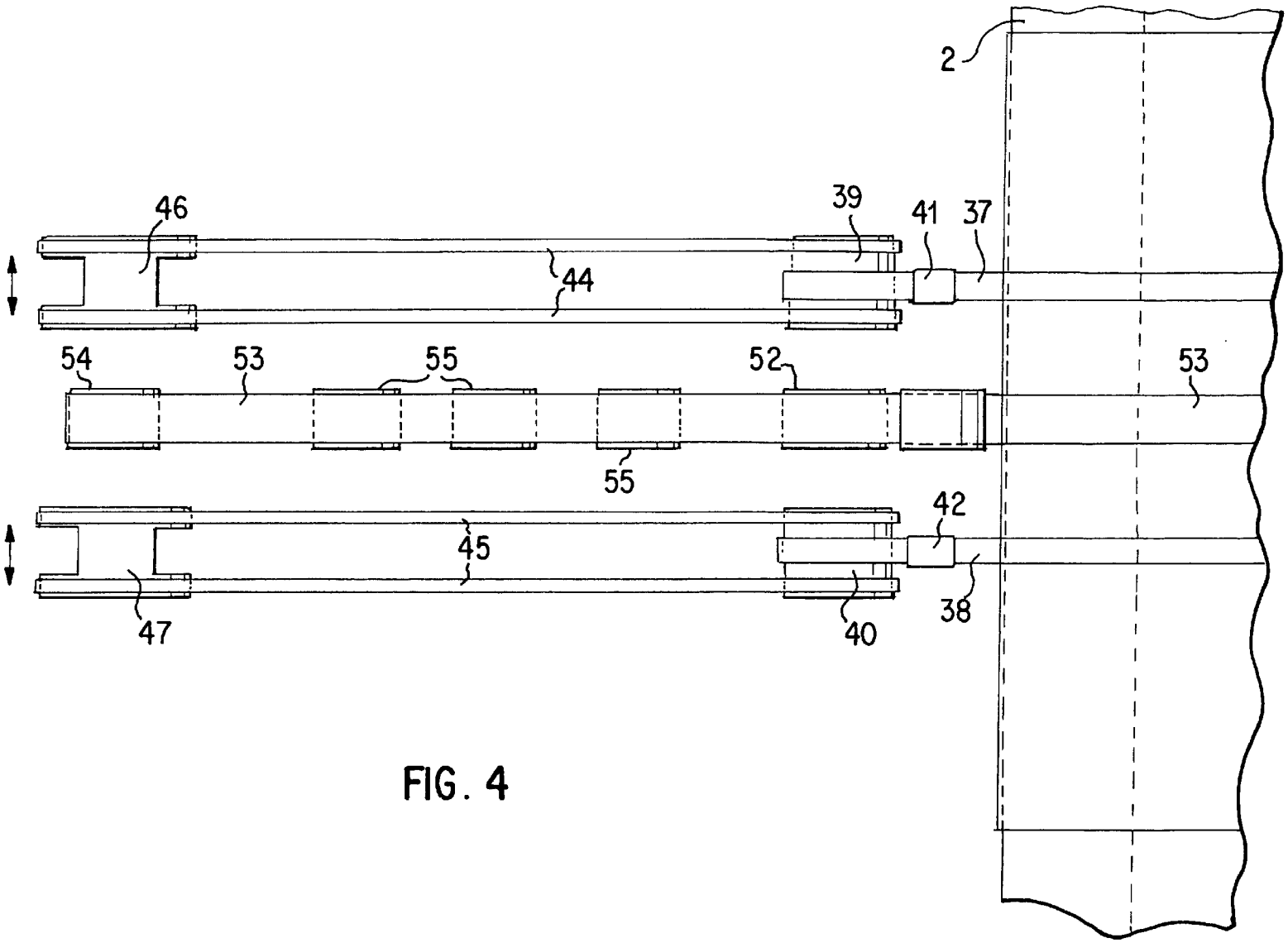
FIG. 4 is a bottom view of the upper bands and belts with the corresponding deflection and guide rollers.

The belts that produce the profile can also be moved out of the transport plane of the two-belt conveyor 29 as shown in FIG. 2. The belts are moved in this way by correspondingly lifting or lowering the frame parts collectively. Due to this, the tubular section to be profiled may be provided with a central approximately trapezoidal profile in addition to the lateral undulated profile.

We claim:

1. A device for stiffening tubular sections of paper used in the manufacture of bags comprising: an intake end, an outlet end comprising a pair of opposed freely rotatable rollers around which freely rotatable elements pass for providing the tubular sections with an undulated profile, respective sections of said freely rotatable elements coming in contact with the tubular sections and extending through a common central plane in such a way that they provide the tubular sections with an approximately undulated profile, a conveyor arranged adjacent to the freely rotatable elements and having conveyor sections between which the workpieces are clamped, a pair of adjustable frames for adjusting the position of the rotatable rollers relative to one another within a machine frame in which said rollers elements and conveyor are arranged, and a plurality devices provided at opposite ends of said adjustable frames for raising and lowering the adjustable frames, wherein the freely rotatable elements are belts that revolve around the freely rotatable rollers and the adjustable frames are arranged in the machine frame such that said pair of opposed rollers at said outlet end thereof can be pivoted away from one another.

2. A device according to claim 1, wherein the adjusting devices are cams.

3. A device for stiffening tubular sections of paper used in the manufacture of bags comprising:

freely rotatable elements that provide the tubular sections with an undulated profile, freely rotatable rollers around which the freely rotatable elements pass, respective sections of said freely rotatable elements coming in contact with the tubular sections and extending through a common central plane in such a way that they provide the tubular sections with an approximately undulated profile, a conveyor arranged adjacent to the freely rotatable elements and having conveyor sections between which the workpieces are clamped, and pairs of deflection rollers on an outlet side and on an inlet side of the device, wherein the deflection rollers on the outlet side have larger diameters than the deflection rollers on the inlet side.

4. A device for stiffening tubular sections of paper used in the manufacture of bags comprising:

freely rotatable elements that provide the tubular sections with an undulated profile, freely rotatable rollers around which the freely rotatable elements pass, respective sections of said freely rotatable elements coming in contact with the tubular sections and extending through a common central plane in such a way that they provide the tubular sections with an approximately undulated profile, a two-belt conveyor arranged adjacent to the freely rotatable elements and having upper and lower sections between which the workpieces are clamped, adjustable frames that can be adjusted relative to one another within a machine frame in which the belts are arranged, and curved profiling plates arranged on one of the frames with lateral regions of the tubular sections passing between said profiling plates, wherein the freely rotatable elements are belts that revolve around the freely rotatable rollers.

* * * * *